US009477192B1

(12) United States Patent
Uto et al.

(10) Patent No.: US 9,477,192 B1
(45) Date of Patent: Oct. 25, 2016

(54) IMAGE FORMING APPARATUS WITH SOUND GENERATING UNIT

(71) Applicant: FUJI XEROX CO., LTD., Tokyo (JP)

(72) Inventors: Osamu Uto, Yokohama (JP); Ryosuke Nara, Yokohama (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/933,652

(22) Filed: Nov. 5, 2015

(30) Foreign Application Priority Data

Jun. 19, 2015 (JP) ..... 2015-123691

(51) Int. Cl.
*G03G 15/00* (2006.01)

(52) U.S. Cl.
CPC ..... *G03G 15/5016* (2013.01)

(58) Field of Classification Search
CPC ..... G03G 15/5016
See application file for complete search history.

(56) References Cited

U.S. PATENT DOCUMENTS 7,692,824 B2 * 4/2010 Shirai ..... B65H 7/06 358/474
8,339,657 B2 * 12/2012 Yamazaki ..... H04N 1/00209 271/3.01
2006/0257183 A1 * 11/2006 Ehara ..... G03G 15/6552 399/405
2011/0116815 A1 * 5/2011 Taniuchi ..... B41J 2/17566 399/24
2014/0255057 A1 * 9/2014 Yoshino ..... G03G 21/206 399/92
2014/0301744 A1 * 10/2014 Tenjiku ..... G03G 21/1842 399/13

FOREIGN PATENT DOCUMENTS

JP 56159656 A * 12/1981
JP H10-313373 A 11/1998

* cited by examiner

*Primary Examiner* — Francis Gray
(74) *Attorney, Agent, or Firm* — Oliff PLC

(57) ABSTRACT

An image forming apparatus includes an apparatus body having an inner sheet-output space provided between an image forming unit and an image reading unit provided above the image forming unit, the inner sheet-output space being open on an operator side of the apparatus body; and a sound generating unit provided on the operator side of the apparatus body and facing toward the inner sheet-output space.

4 Claims, 6 Drawing Sheets

IMAGE FORMING APPARATUS WITH SOUND GENERATING UNIT

CROSS-REFERENCE TO RELATED APPLICATIONS

This application is based on and claims priority under 35 USC 119 from Japanese Patent Application No. 2015-123691 filed Jun. 19, 2015.

BACKGROUND

Technical Field

The present invention relates to an image forming apparatus.

SUMMARY

According to an aspect of the invention, there is provided an image forming apparatus including an apparatus body having an inner sheet-output space provided between an image forming unit and an image reading unit provided above the image forming unit, the inner sheet-output space being open on an operator side of the apparatus body; and a sound generating unit provided on the operator side of the apparatus body and facing toward the inner sheet-output space.

BRIEF DESCRIPTION OF THE DRAWINGS

Exemplary embodiments of the present invention will be described in detail based on the following figures, wherein.

DETAILED DESCRIPTION

Figure 1:
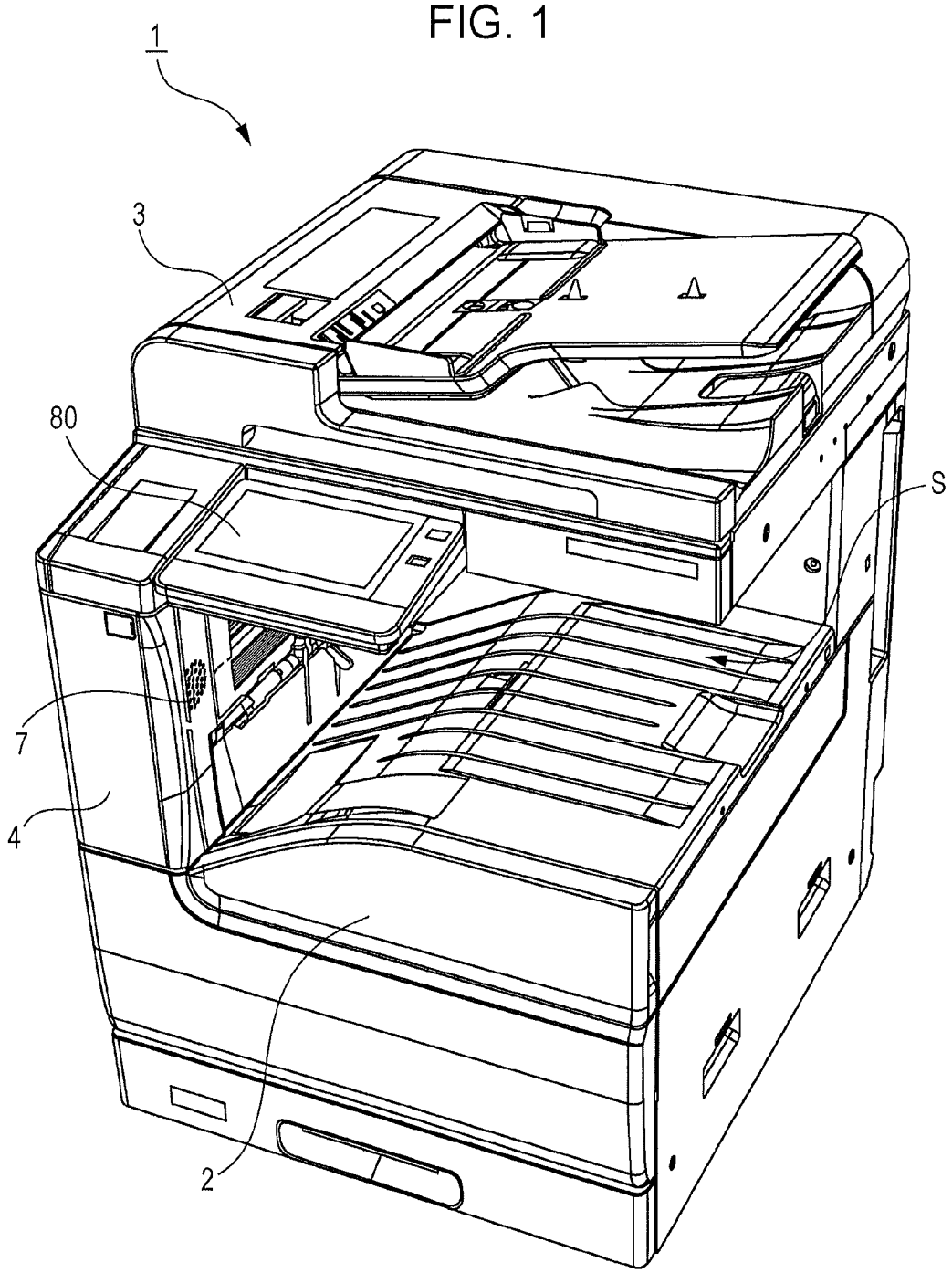
FIG. 1 is a perspective view of an image forming apparatus according to a first exemplary embodiment of the present invention and illustrates the overall appearance thereof.

The drawings to be referred to in the following description are only schematic, and individual elements illustrated therein are not necessarily scaled in accordance with their actual sizes. For easy understanding, irrelevant elements are not illustrated.

For easy understanding of the following description, directions in the drawings are defined as follows (see FIG. 2): the lateral direction corresponds to the X-axis direction, the anteroposterior direction corresponds to the Y-axis direction, and the vertical direction corresponds to the Z-axis direction.

First Exemplary Embodiment

(1) Overall Configuration and Operation of Image Forming Apparatus

Figure 2:
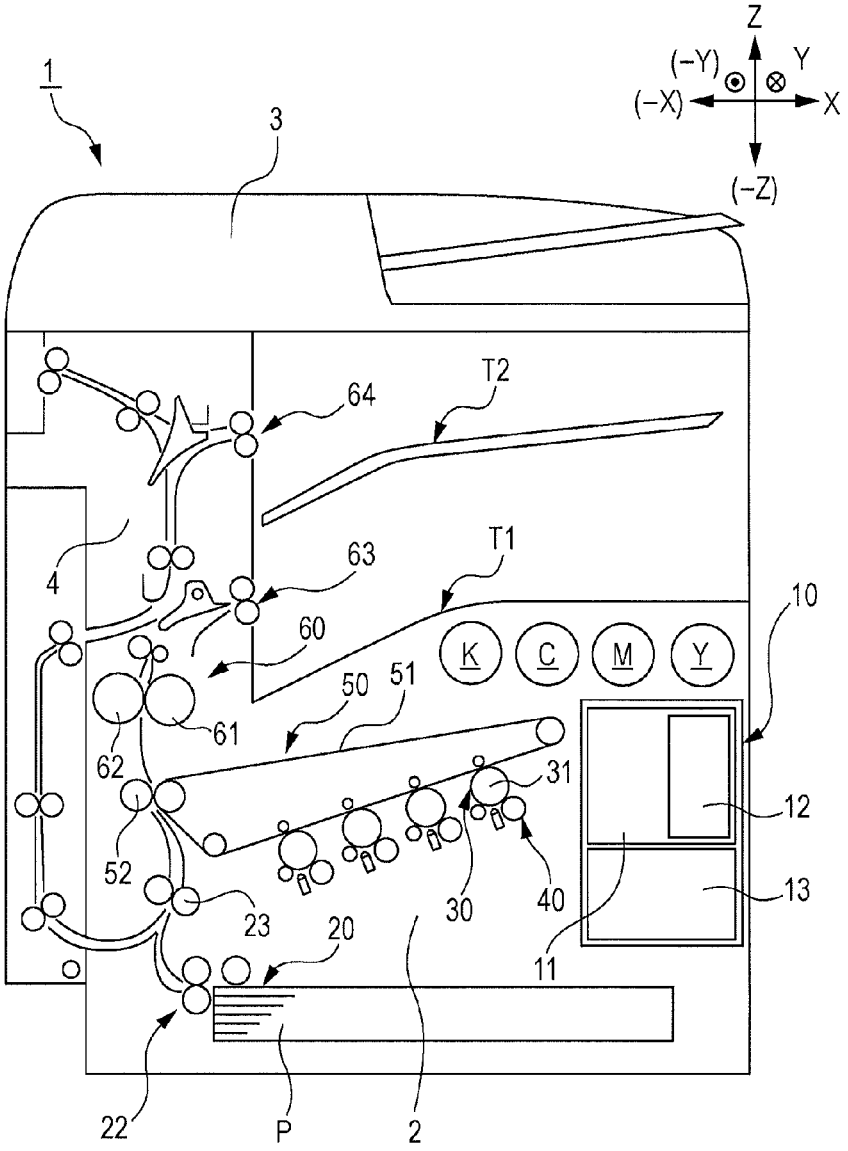
FIG. 2 is a schematic sectional view of the image forming apparatus and illustrates the internal configuration thereof.

FIG. 1 is a perspective view of an image forming apparatus 1 according to a first exemplary embodiment of the present invention and illustrates the overall appearance thereof. FIG. 2 is a schematic sectional view of the image forming apparatus 1 and illustrates the internal configuration thereof.

Referring to FIGS. 1 and 2, the overall configuration and operation of the image forming apparatus 1 will now be described.

(1.1) Overall Configuration

The image forming apparatus 1 includes an image forming unit 2 that electrophotographically forms an image, and a reading unit 3 that reads a document or the like. The reading unit 3 is supported above the image forming unit 2 by a reading-unit-supporting portion 4. An inner sheet-output space S in which sheets P discharged by a pair of first discharge rollers 63 or a pair of second discharge rollers 64 are stacked is provided between the image forming unit 2 and the reading unit 3.

The reading-unit-supporting portion 4 is provided with a speaker 7 as a sound generating unit. The speaker 7 is provided on an operator side of the image forming apparatus 1 and faces toward the inner sheet-output space S.

The image forming unit 2 has a housing F (not illustrated), in which a control device 10, a sheet feeding device 20, photoconductor units 30, developing devices 40, a transfer device 50, and a fixing device 60 are provided. The housing F (not illustrated) is formed of plural exterior members 5 that are separate from one another.

The reading unit 3 is provided on the front side thereof with an operation information portion 80 as a user interface. The operation information portion 80 is a combination of a liquid-crystal display panel, operation buttons, a touch panel, and so forth. The user of the image forming apparatus 1 inputs associated settings and instructions into the image forming apparatus 1 through the operation information portion 80. Furthermore, associated pieces of information are displayed to the user of the image forming apparatus 1 through the liquid-crystal display panel.

(1.2) Image Forming Unit

The control device 10 includes an image-forming-apparatus controller 11 that controls the operation of the image forming apparatus 1, a controller portion 12 that prepares image data in accordance with a printing request, a power supply 13, and so forth.

The image forming unit 2 is provided at the bottom thereof with the sheet feeding device 20 in which plural sheets P as recording media are stacked. The sheets P whose position in the width direction is determined by a regulating plate (not illustrated) are picked up one by one from the top of the stack by a sheet pickup member 22 toward the left side (in the −X direction). The sheet P thus picked up is transported to a nip part between a pair of registration rollers 23.

The photoconductor units 30 are arranged side by side above the sheet feeding device 20 (in the Z direction) and include respective photoconductor drums 31 as image carriers that are driven to rotate. The developing devices 40 form toner images in colors of yellow (Y), magenta (M), cyan (C), and black (K) on the photoconductor drums 31, respectively.

The toner images in the different colors formed on the photoconductor drums 31 of the photoconductor units 30 are sequentially electrostatically transferred to an intermediate transfer belt 51 of the transfer device 50 (in first transfer), whereby the toner images are superposed one on top of another. The toner images superposed on the intermediate transfer belt 51 are collectively transferred by a second transfer roller 52 to the sheet P fed from the pair of registration rollers 23 and guided to the second transfer roller 52 by a transport guide (not illustrated).

The sheet P to which the toner images have been collectively transferred by the transfer device 50 is transported to the fixing device 60 by a transport guide (not illustrated) with the toner images unfixed. The unfixed toner images are fixed under pressure and heat applied thereto by a combination of a fixing roller 61 and a pressing roller 62.

The sheet P having the fixed toner images is guided to the pair of first discharge rollers 63 or the pair of second discharge rollers 64 by a transport guide (not illustrated) and is discharged by the pair of first discharge rollers 63 or the pair of second discharge rollers 64 onto a sheet output tray T1 or T2 provided in the inner sheet-output space S.

(2) Position of Speaker

Figure 3A:
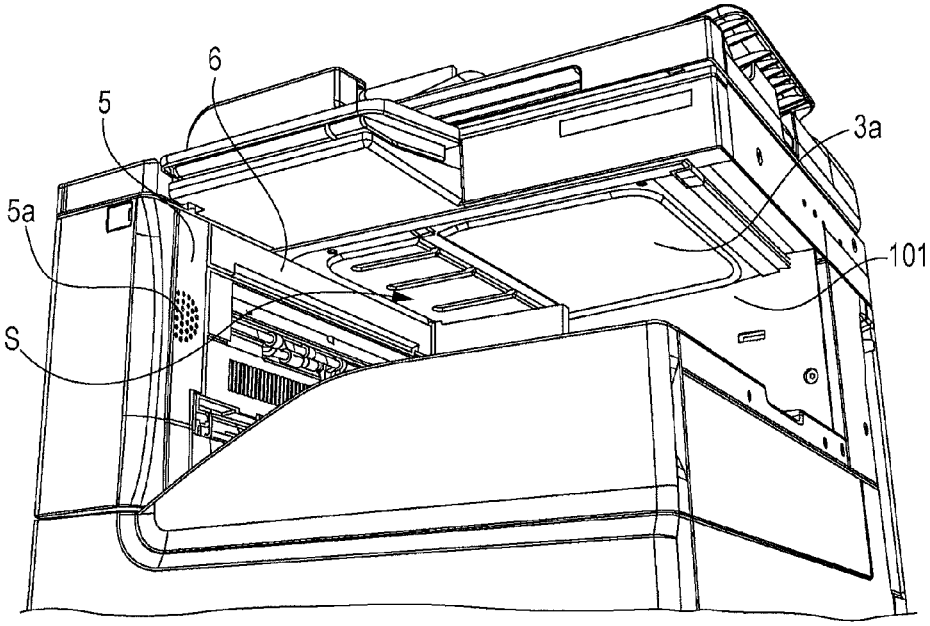
FIG. 3A is a perspective view of the image forming apparatus that is seen from an operator side, and illustrates an inner sheet-output space and the periphery thereof, focusing on a bottom portion of a reading unit.
Figure 3B:
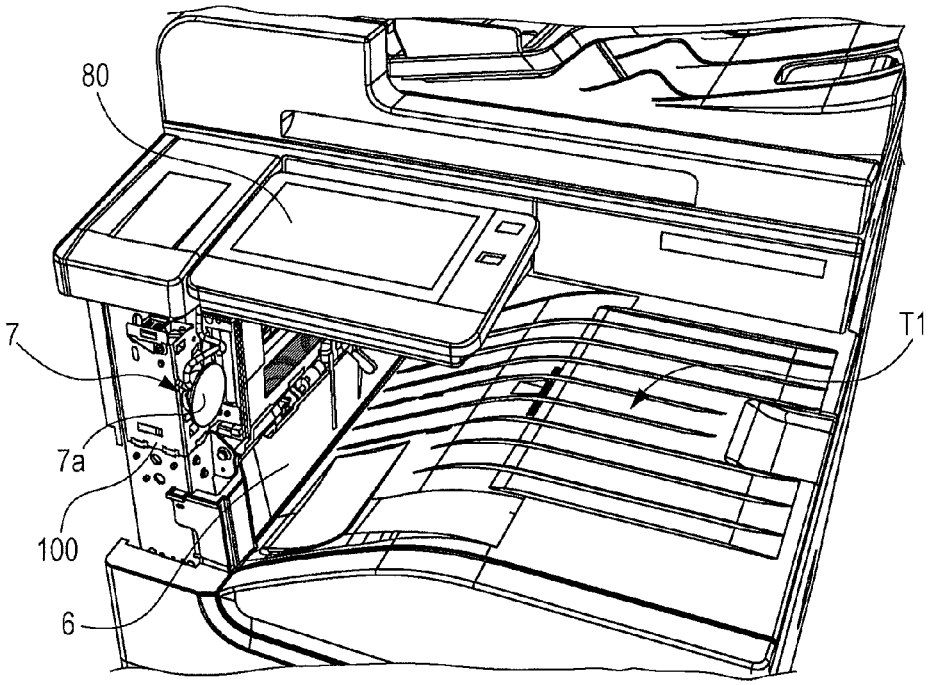
FIG. 3B is a perspective view of the image forming apparatus, with an exterior member that covers a reading-unit-supporting portion removed.
Figure 4:
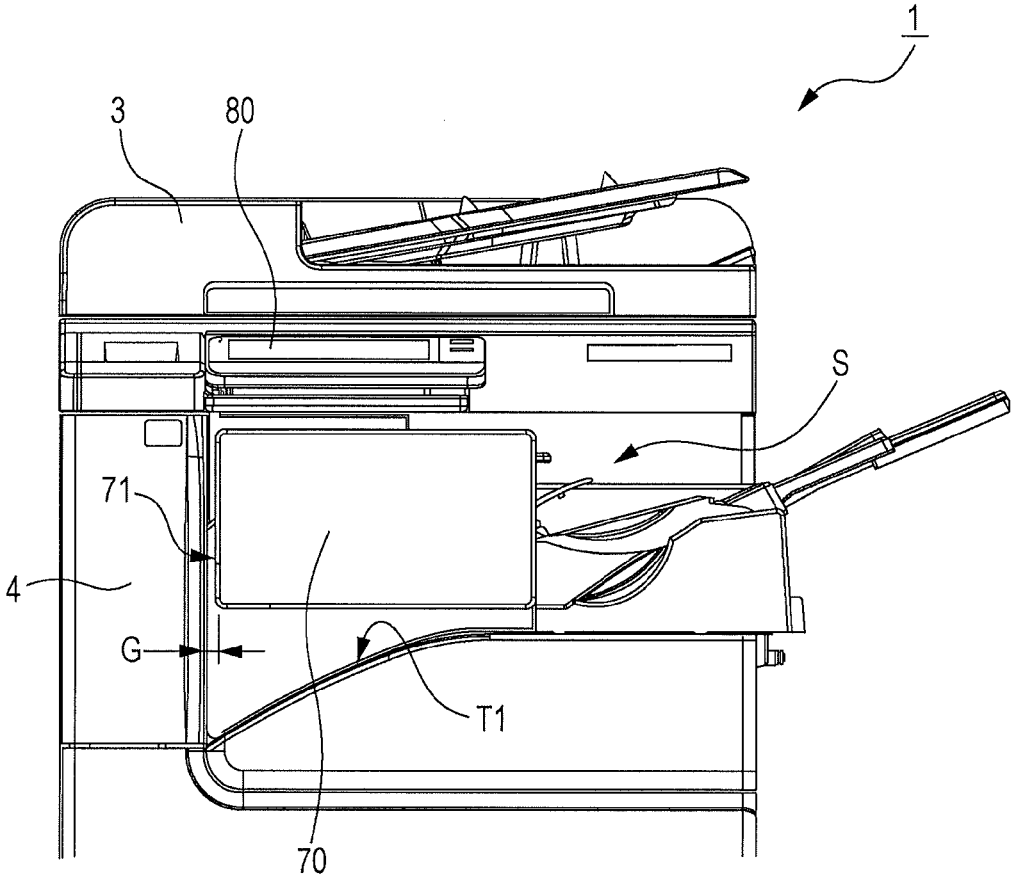
FIG. 4 is a front view of the image forming apparatus, with a finishing sheet-processing device attached thereto in the inner sheet-output space.

FIG. 3A is a perspective view of the image forming apparatus 1 that is seen from the operator side, and illustrates the inner sheet-output space S and the periphery thereof, focusing on a bottom portion 3*a* of the reading unit 3. FIG. 3B is a perspective view of the image forming apparatus 1, with one of the exterior members 5 that covers the reading-unit-supporting portion 4 removed. FIG. 4 is a front view of the image forming apparatus 1, with a finishing sheet-processing device 70 attached thereto in the inner sheet-output space S.

Referring to FIGS. 3A, 3B, and 4, the position of the speaker 7 in the image forming apparatus 1 will now be described.

(2.1) Inner Sheet-Output Space

The inner sheet-output space S of the image forming apparatus 1 is defined by the reading-unit-supporting portion 4 and an exterior member 6 on one lateral side thereof, the sheet output tray T1 of the image forming unit 2 on the lower side thereof, the bottom portion 3*a* of the reading unit 3 on the upper side thereof, and a rear panel 101 on the rear side thereof, with the front side thereof being open to the operator. The reading-unit-supporting portion 4 is a pillar portion that supports the reading unit 3. The exterior member 6 covers a sheet discharge portion, where the pair of first discharge rollers 63 and the pair of second discharge rollers 64 are exposed to the outside of the image forming unit 2.

(2.2) Speaker

The exterior member 5 that is provided on the operator side of the reading-unit-supporting portion 4 is a holed member having holes that are open to the inner sheet-output space S.

The exterior member 5 covers a pillar 100 included in the reading-unit-supporting portion 4 and has plural sound releasing holes 5*a* each extending from the inner side through to the outer side of the exterior member 5. The sound releasing holes 5*a* allow an alarm sound that is output from the speaker 7 to pass therethrough. The speaker 7 is fixed to the pillar 100 behind the exterior member 5. Desirably, the sound releasing holes 5*a* are provided at an opening ratio of 50% or higher with respect to the caliber of the speaker 7.

As illustrated in FIG. 3B, the speaker 7 as a sound generating unit is provided on the pillar 100, which supports the operator-side end of the reading unit 3, and the speaker 7 faces toward the inner sheet-output space S.

The speaker 7 is a small-caliber speaker unit and includes, for example, a diaphragm 7*a* having a radius of about 20 mm. The speaker 7 is controlled by the control device 10. The sound generated from the back of the diaphragm 7*a* provides the operator notifications of errors or job completion, audio operation guides, and so forth.

Exemplary error notifications include notifications of, a jam or misfeed of a document in a document feeder of the reading unit 3, a jam or misfeed of a sheet P in the sheet feeding device 20, a breakdown of hardware included in the image forming unit 2 or the control device 10, and so forth.

The image forming apparatus 1 according to the first exemplary embodiment includes the speaker 7 that provides the operator with notifications of errors or job completion, audio operation guides, and so forth. The speaker 7 is provided on the operator side of the body of the image forming apparatus 1 and faces toward the inner sheet-output space S.

Therefore, the alarm sound that is output from the speaker 7 is released toward the operator side while the alarm sound is made to echo on the exterior member 6, the sheet output tray T1, the bottom portion 3*a* of the reading unit 3, the rear panel 101, and so forth that define the inner sheet-output space S. Thus, the alarm sound is assuredly delivered to the operator while the reduction in the sound pressure is suppressed.

The speaker 7 is concealed from the outside by the exterior member 5 having the plural sound releasing holes 5*a* that are open to the inner sheet-output space S, and is fixed to the pillar 100 behind the exterior member 5.

Therefore, the speaker 7 and the sound releasing holes 5*a* are less visible from the outside of the image forming apparatus 1, and favorable appearance is provided.

(2.3) Attaching Finishing Sheet-Processing Device

As illustrated in FIG. 4, the finishing sheet-processing device 70 may be provided in the inner sheet-output space S of the image forming apparatus 1. The finishing sheet-processing device 70 performs a finishing process on sheets P discharged by the pair of first discharge rollers 63 or the pair of second discharge rollers 64. For example, the finishing sheet-processing device 70 makes a stack of sheets P discharged by the pair of first discharge rollers 63 or the pair of second discharge rollers 64 and binds the stack of sheets P.

The finishing sheet-processing device 70 is set on the upper surface of the sheet output tray T1 in the inner sheet-output space S. In this state, a gap G is provided between a sheet receiving surface 71 of the finishing sheet-processing device 70 and the reading-unit-supporting portion 4 (see FIG. 4).

Hence, the alarm sound that is output from the speaker 7 provided on the operator side of the reading-unit-supporting portion 4 and facing toward the inner sheet-output space S is reflected by the sheet receiving surface 71 of the finishing sheet-processing device 70 and is released from the gap G toward the operator side, thereby being assuredly delivered to the operator.

Second Exemplary Embodiment (1) Position of Speaker

The position of a speaker 7 in an image forming apparatus 1A according to a second exemplary embodiment of the present invention will now be described with reference to FIGS. 5 and 6. Elements that are the same as those of the image forming apparatus 1 according to the first exemplary embodiment are denoted by corresponding ones of the reference numerals used in the first exemplary embodiment, and detailed description thereof is omitted.

Figure 5:
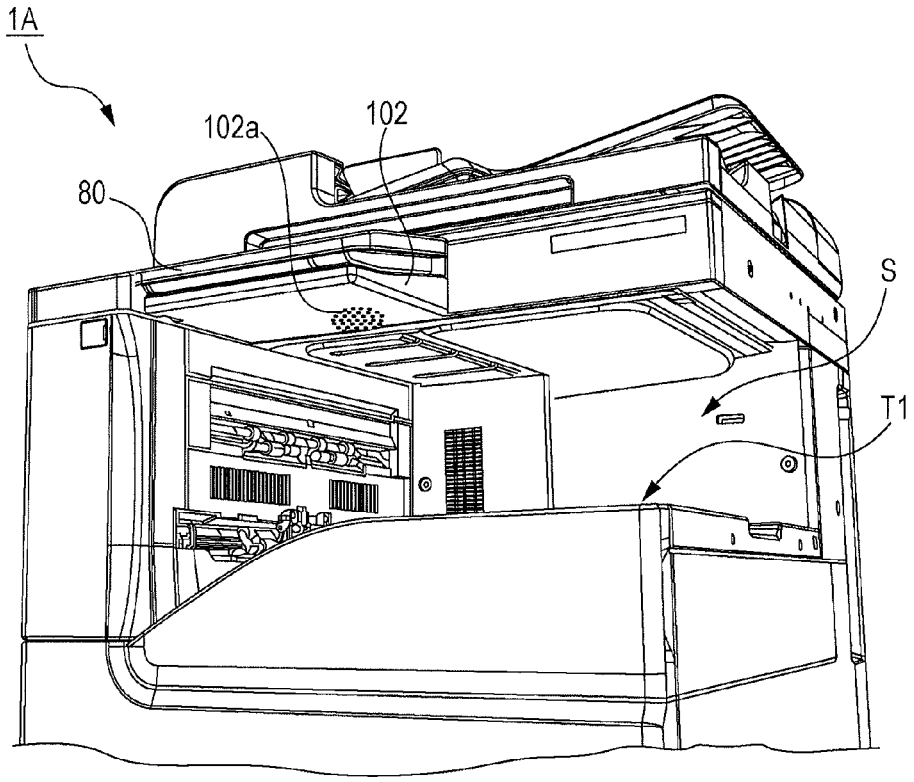
FIG. 5 is a perspective view of an image forming apparatus according to a second exemplary embodiment of the present invention that is seen from the operator side, and illustrates an inner sheet-output space and the periphery thereof, focusing on a bottom portion of a reading unit.

FIG. 5 is a perspective view of the image forming apparatus 1A that is seen from the operator side, and illustrates the inner sheet-output space S and the periphery thereof, focusing on the bottom portion 3*a* of the reading unit 3. FIG. 6 is a perspective view of the image forming apparatus 1A, focusing on the operation information portion 80, with the finishing sheet-processing device 70 attached to the image forming apparatus 1A in the inner sheet-output space S.

As illustrated in FIG. 5, the speaker 7 as a sound generating unit of the image forming apparatus 1A is provided at the bottom of the operation information portion 80 and faces toward the inner sheet-output space S. The operation information portion 80 projects from the reading unit 3 toward the operator side.

The image forming apparatus 1A includes a supporting portion 102 fixed to the reading unit 3 and projecting from the reading unit 3 toward the operator side. The operation information portion 80 according to the second exemplary embodiment is detachably supported at the top of the supporting portion 102.

The bottom face of the supporting portion 102 has plural sound releasing holes 102*a* each extending from the inner side through to the outer side of the supporting portion 102. The sound releasing holes 102*a* allow the alarm sound that is output from the speaker 7 provided behind the supporting portion 102 to be released downward into the inner sheet-output space S.

The alarm sound thus output from the bottom of the supporting portion 102 is reflected by the sheet output tray T1 defining the lower side of the inner sheet-output space S and is released toward the operator side. Thus, the alarm sound is assuredly delivered to the operator.

The plural sound releasing holes 102*a* provided in the bottom face of the supporting portion 102 that supports the operation information portion 80 face down toward the inner sheet-output space S and are therefore less visible from the operator side. Thus, favorable appearance is provided.

Figure 6:
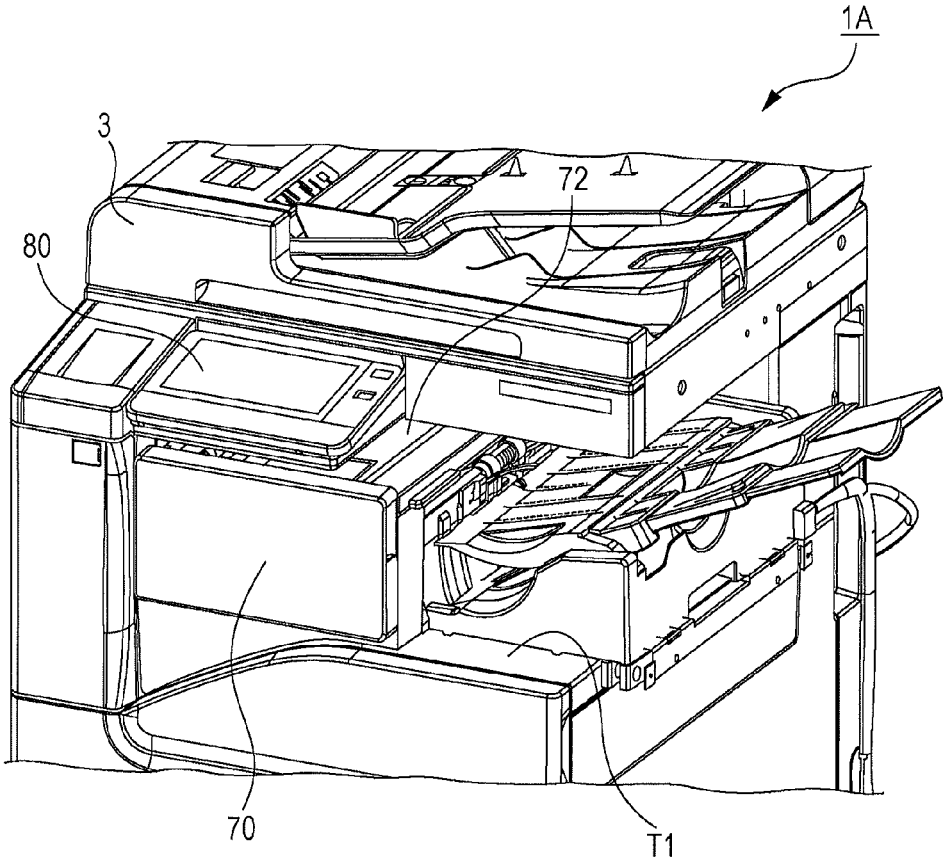
FIG. 6 is a perspective view of the image forming apparatus, focusing on an operation information portion, with a finishing sheet-processing device attached to the image forming apparatus in the inner sheet-output space.

As illustrated in FIG. 6, the finishing sheet-processing device 70 may be provided in the inner sheet-output space S of the image forming apparatus 1A. The finishing sheet-processing device 70 performs a finishing process on sheets P discharged by the pair of first discharge rollers 63 or the pair of second discharge rollers 64. If the finishing sheet-processing device 70 is set in the inner sheet-output space S, the alarm sound that is output from the speaker 7 provided at the bottom of the operation information portion 80 and facing down toward the inner sheet-output space S is reflected by a top portion 72 of the finishing sheet-processing device 70 and is released toward the operator side. Thus, the alarm sound is assuredly delivered to the operator.

The first exemplary embodiment and the second exemplary embodiment each concern a case where the image forming apparatus 1 or 1A includes the speaker 7 as a sound generating unit. Alternatively, the sound generating unit may be a buzzer that provides notifications of errors, job completion, and so forth.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an apparatus body defining an inner sheet-output space provided between an image forming unit and an image reading unit provided above the image forming unit, the inner sheet-output space being open on an operator side of the apparatus body; and a sound generating unit provided on the operator side of the apparatus body and facing toward the inner sheet-output space and facing a direction that sheets are output into the inner sheet-output space.

2. The image forming apparatus according to claim 1, wherein the sound generating unit is provided on a pillar portion that supports one end of the image reading unit and on the operator side of the image reading unit.

3. The image forming apparatus according to claim 1, further comprising:

an operation information portion projecting from the image reading unit toward the operator side, wherein the sound generating unit is provided at a bottom of the operation information portion.

4. The image forming apparatus according to claim 1, wherein the sound generating unit is provided behind a holed member having a plurality of sound releasing holes through which a sound generated by the sound generating unit passes.

* * * * *